US008113375B2

(12) United States Patent
Jeon

(10) Patent No.: US 8,113,375 B2
(45) **Date of Patent: *Feb. 14, 2012**

(54) EASILY OPENABLE CAN LID HAVING A MOVABLE PORTION

(75) Inventor: Jeong-Wook Jeon, Pyungtaek-si (KR)

(73) Assignee: Crown Packaging Technology, Inc., Alsip, IL (US)

( * ) Notice: Subject to any disclaimer, the term of this patent is extended or adjusted under 35 U.S.C. 154(b) by 866 days.

This patent is subject to a terminal disclaimer.

(21) Appl. No.: 11/613,909

(22) Filed: Dec. 20, 2006

(65) Prior Publication Data

US 2007/0108209 A1 May 17, 2007

Related U.S. Application Data

(63) Continuation of application No. 10/517,217, filed on Dec. 3, 2004, now Pat. No. 7,168,586.

(30) Foreign Application Priority Data

Jun. 11, 2002 (KR) ..... 20-2002-0017694 U
May 27, 2003 (KR) ..... PCT/KR03/01033

(51) Int. Cl.
*B65D 17/34* (2006.01)

(52) U.S. Cl. ..... 220/270; 220/212; 220/272; 220/906; 215/230

(58) Field of Classification Search ..... 40/311; 215/230, 274; 220/906, 212, 270, 272, 273, 220/276

See application file for complete search history.

(56) References Cited

U.S. PATENT DOCUMENTS

| | | | | | |
|---|---|---|---|---|---|
| 2,261,117 | A | * | 11/1941 | Jack, Jr. | 220/269 |
| D200,021 | S | * | 1/1965 | Bozek | D9/438 |
| 3,369,689 | A | * | 2/1968 | Dodge | 215/262 |
| 3,404,801 | A | * | 10/1968 | Silver | 220/269 |
| 3,477,608 | A | * | 11/1969 | Fraze | 220/273 |
| D219,370 | S | * | 12/1970 | Saunders | D9/438 |
| 3,559,843 | A | * | 2/1971 | Kern | 220/281 |

(Continued)

FOREIGN PATENT DOCUMENTS

EP 0 088 185 A1 9/1983

(Continued)

OTHER PUBLICATIONS

Supplementary European Search Report issued in European patent application No. EP03730882 on Jul. 30, 2007.

(Continued)

*Primary Examiner* — J. Gregory Pickett
*Assistant Examiner* — Ned A Walker
(74) *Attorney, Agent, or Firm* — Woodcock Washburn LLP

(57) ABSTRACT

A can lid of a can provided with an easily openable opening means is disclosed wherein the can lid is equipped with a can lid which is fastened by winding tightly on the can main body and the top end opening of the can main body, a score section installed around the territory of the prearranged opening area and a tab for severing the score section. In the can lid, there is formed a protrusion protruding upward from the can lid in front of the can opening during manufacturing of the can lid, in which it is a collapsing protrusion where the protrusion elastically deforms into the can main body by depressing motion of the user and thereby enables forming of a concave section for easy insertion of the user's finger.

7 Claims, 4 Drawing Sheets

U.S. PATENT DOCUMENTS

| | | | | | |
|---|---|---|---|---|---|
| D221,930 | S | * | 9/1971 | Saunders | D9/438 |
| 3,662,916 | A | * | 5/1972 | Holk, Jr. | 220/273 |
| D224,209 | S | * | 7/1972 | Kinkel | D9/438 |
| D226,071 | S | * | 1/1973 | Saunders | D9/438 |
| D226,073 | S | * | 1/1973 | Westphal | D9/438 |
| 3,724,709 | A | * | 4/1973 | Westphal | 220/273 |
| 3,744,662 | A | | 7/1973 | Zundel | |
| 3,762,596 | A | * | 10/1973 | Henning et al. | 220/273 |
| 3,779,417 | A | * | 12/1973 | Klein | 220/268 |
| 3,905,513 | A | * | 9/1975 | Klein | 220/268 |
| 3,929,251 | A | * | 12/1975 | Urmston | 220/268 |
| 3,930,592 | A | * | 1/1976 | Dilanni | 220/270 |
| 3,938,696 | A | * | 2/1976 | Herbst | 220/273 |
| 3,941,277 | A | * | 3/1976 | McKinney et al. | 220/273 |
| 3,951,299 | A | * | 4/1976 | Khoury | 220/273 |
| D243,833 | S | * | 3/1977 | Markert | D9/438 |
| 4,030,631 | A | * | 6/1977 | Brown | 220/269 |
| 4,150,777 | A | | 4/1979 | Cyr et al. | |
| 4,205,760 | A | * | 6/1980 | Hasegawa | 220/271 |
| 4,252,247 | A | * | 2/1981 | Asbury | 220/268 |
| 4,266,688 | A | | 5/1981 | Reid | 220/273 |
| D263,803 | S | * | 4/1982 | Fraze | D9/438 |
| 4,333,581 | A | * | 6/1982 | Flansburg | 220/501 |
| 4,361,244 | A | | 11/1982 | Walter | |
| 4,369,888 | A | | 1/1983 | Walter | |
| 4,397,400 | A | | 8/1983 | Walter | |
| 4,442,950 | A | * | 4/1984 | Wilson | 220/269 |
| 4,463,866 | A | * | 8/1984 | Mandel | 220/269 |
| 4,503,989 | A | * | 3/1985 | Brown et al. | 220/269 |
| D278,980 | S | * | 5/1985 | Brown et al. | D9/438 |
| 4,559,729 | A | * | 12/1985 | White | 40/306 |
| 4,701,090 | A | * | 10/1987 | Smith | 413/13 |
| 4,747,511 | A | * | 5/1988 | Dutt et al. | 220/254.2 |
| D307,720 | S | * | 5/1990 | Saunders et al. | D9/438 |
| 5,011,037 | A | * | 4/1991 | Moen et al. | 220/271 |
| D321,326 | S | * | 11/1991 | Harwood | D9/438 |
| 5,064,087 | A | * | 11/1991 | Koch | 220/269 |
| D332,402 | S | * | 1/1993 | Harwood et al. | D9/438 |
| 5,199,618 | A | | 4/1993 | Reil et al. | |
| 5,307,947 | A | * | 5/1994 | Moen et al. | 220/266 |
| 5,335,808 | A | | 8/1994 | Lee | 220/269 |
| 5,622,273 | A | | 4/1997 | Kelly | |
| 5,743,445 | A | * | 4/1998 | Benarrouch | 222/541.9 |
| 5,813,561 | A | | 9/1998 | Chang et al. | 220/269 |
| 5,947,317 | A | | 9/1999 | Hall | 220/269 |
| 6,059,137 | A | * | 5/2000 | Westwood et al. | 220/258.2 |
| 6,105,806 | A | | 8/2000 | Stasiuk | 220/269 |
| D432,015 | S | * | 10/2000 | Holiday | D9/772 |
| 6,138,856 | A | * | 10/2000 | Ghim et al. | 220/269 |
| 6,206,220 | B1 | * | 3/2001 | Stodd | 220/231 |
| 6,427,861 | B1 | * | 8/2002 | Cho | 220/269 |
| 7,168,586 | B2 | | 1/2007 | Jeon | 220/269 |
| 7,407,061 | B2 | * | 8/2008 | Fares et al. | 220/254.4 |
| 7,617,945 | B2 | * | 11/2009 | Cherian | 220/269 |
| 2004/0259235 | A1 | * | 12/2004 | Fares et al. | 435/287.1 |
| 2005/0150889 | A1 | | 7/2005 | Perra | |
| 2007/0068943 | A1 | | 3/2007 | Ramsey | |
| 2007/0215620 | A1 | | 9/2007 | Kasper | |

FOREIGN PATENT DOCUMENTS

| | | | | |
|---|---|---|---|---|
| EP | 1577222 | | | 9/2005 |
| FR | 2826939 | A1 | * | 1/2003 |
| GB | 23 200 08 | A | | 6/1998 |
| JP | 61-48128 | | | 5/1994 |
| JP | 2003-054549 | | | 2/2003 |
| JP | 2003054549 | A | * | 2/2003 |
| JP | 2003-112735 | | | 4/2003 |
| KR | 2000-17742 | A | | 4/2000 |
| NL | 7416818 | A | | 7/1975 |
| WO | 01/28875 | A1 | | 4/2001 |
| WO | WO 02/08074 | A1 | | 1/2002 |
| WO | 2007/039367 | A1 | | 4/2007 |

OTHER PUBLICATIONS

"Advertisement for Boa Housewares', Canpull", The CANMAKER, Jun. 2002, vol. 15, 3 pages.
"Advertisement for Buhrke Tech's New End Opens Easier and Costs Less to Make", The CANMAKER, Jan. 1998, vol. 11, 6 pages.
"Cannex Asia's Seamlingly Endless Possibilities", The CANMAKER, Feb. 2003, vol. 16, 3 pages.
"Contains 100% of Your Daily EOE Requirements", The CANMAKER, Jul. 2000, vol. 13, 3 pages.
"Heinz Takes The Easy Way", The CANMAKER, Jun. 1999, vol. 12, 6 pages.
"HL Foods Chooses Easy-Open Ends", The CANMAKER, Nov. 1999, vol. 12, 5 pages.
"Impress Grabs Heinz Contract", The CANMAKER, Jul. 1999, vol. 12, 6 pages.
"Interesting Openings, Part 3", The CANMAKER, Sep. 1999, vol. 12, 3 pages.
"Modelling Helps Easy-Open End Choice", The CANMAKER, Apr. 2003, vol. 16, 3 pages.
"New Generation of Easy Open Ends", The CANMAKER, Oct. 1998, vol. 11, 3 pages.
"Stacking Giant In France", The CANMAKER, Mar. 1998, vol. 11, 3 pages.
"Tab Orientation For Better Easy-Open Performance", The CANMAKER, May 2001, vol. 14, 3 pages.
"The Ergonomic and Hygienic Can-End", The Easy Can Company, The CANMAKER, Apr. 1998, vol. 11, 5 pages.
"Winter Theme for Toyo's TULC Can", The CANMAKER, Dec. 2002, vol. 15, 6 pages.
Bailey, "Making it Easier", The CANMAKER, Dec. 1998, vol. 11, 4 pages.
Bailey, "Quality, Not Commodity", The CANMAKER, Feb. 2000, vol. 13, 6 pages.
Glendenning, "Ends Are Just The Beginning", The CANMAKER, Jul. 2001, vol. 11, 9 pages.
Higuera, "Into the Spotlight", The CANMAKER, Jun. 2003, vol. 16, 3 pages.
Nutting, "Canned Convenience", The CANMAKER, Sep. 2000, vol. 13, 5 pages.
Nutting, "Corned Beef Comes of Age", The CANMAKER, Aug. 2003, vol. 16, 3 pages.
Nutting, "Legendary Success, UK Awards", The CANMAKER, Nov. 2003, vol. 16, 4 pages.
Nutting, "Performance Proposal", The CANMAKER, Oct. 2000, vol. 13, 4 pages.
Nutting, "The Sweet Aroma of Success", The CANMAKER, Jun. 2001, vol. 14, 4 pages.
Nutting, "Thinner, Lighter, Easier", The CANMAKER, Nov. 2000, vol. 13, 4 pages.
Nutting, "Uncrowned Champs", The CANMAKER, Aug. 2001, vol. 14, 3 pages.
Nutting, "Uphill Struggle", The CANMAKER, Jul. 2003, vol. 16, 4 pages.
Page, "The Rigours of Processing", The CANMAKER, Jan. 1999, vol. 12, 3 pages.
Pye, "Visible Benefits . . . Easy Does it", The CANMAKER, Jun. 1998, vol. 11, 5 pages.
Searle, "A Century of Ends", The CANMAKER, Jul. 2006, vol. 19, 4 pages.
Amtsblatt des Kantons Graubünden, "Hinged, resealable closures for metal can ends," 1996, 2746-2747.

* cited by examiner

EASILY OPENABLE CAN LID HAVING A MOVABLE PORTION

CROSS-REFERENCE TO RELATED APPLICATIONS

This is a continuation of U.S. Ser. No. 10/517,217 filed Dec. 3, 2004, which is a National Stage Entry of application number PCT/KR03/01033 filed May 27, 2003, which claims priority to Republic of Korea application number 20-2002-0017694 filed Jun. 11, 2002.

TECHNICAL FIELD

The present invention is related to a can which enables easy partial opening or full opening of the lid, and in particular to an easily openable can lid provided with a collapsing protrusion.

BACKGROUND ART

Generally, easily opening lids are required in cans and therefore can lids with easily openable means are installed.

However, in the case of cans provided with easily openable means, easy opening of the can is required but the gap between the handle tab and the top panel of the can is very small and therefore the hooking of the finger is not favorable and thus there is a tendency of it being difficult to open. As a countermeasure, a method of providing a concave portion underneath the tab or a convex portion on the top surface of the can and lifting the tab has been devised. However, if the depth of the concave or convex portion becomes large, there is the problem of tabs of other can lids being caught between the tab and can lid during manufacturing and return transportation and causing damage.

SUMMARY OF THE INVENTION

The present invention has been set forth to overcome the problems of the conventional cans where the object thereof is to provide a can lid provided with an easily openable opening means in which hooking of the finger is facilitated and where there are no problems during manufacturing or transportation.

To achieve the foregoing object, in the present invention in which a can lid of a can provided with an easily openable opening means equipped with a can lid which is fastened by winding tightly on the can main body and the top end opening of the can main body, a score section is installed around the territory of the prearranged opening area and a tab for severing the score section, where in said can lid, there is formed a protrusion protruding upward from the can lid in front of the can opening during manufacturing of the can lid, in which it is a collapsing protrusion where the protrusion elastically deforms into the can main body by depressing motion of the user and thereby enables forming of a concave section for easy insertion of the user's finger. In addition, it is preferred that the end of the handle of said tab lies over the collapsing protrusion.

DESCRIPTION OF THE PREFERRED EMBODIMENTS

Figure 1A:
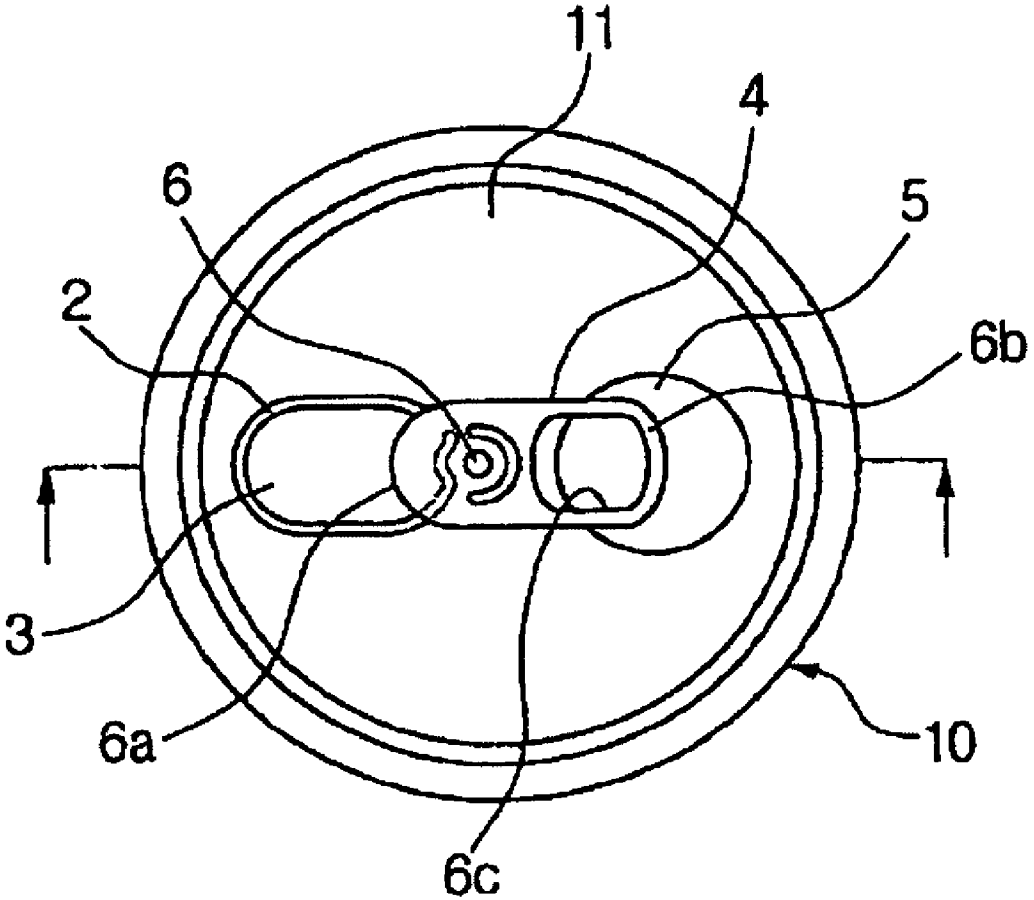
FIG. 1A is a front view of a can lid according to an embodiment of the present invention.
Figure 1B:
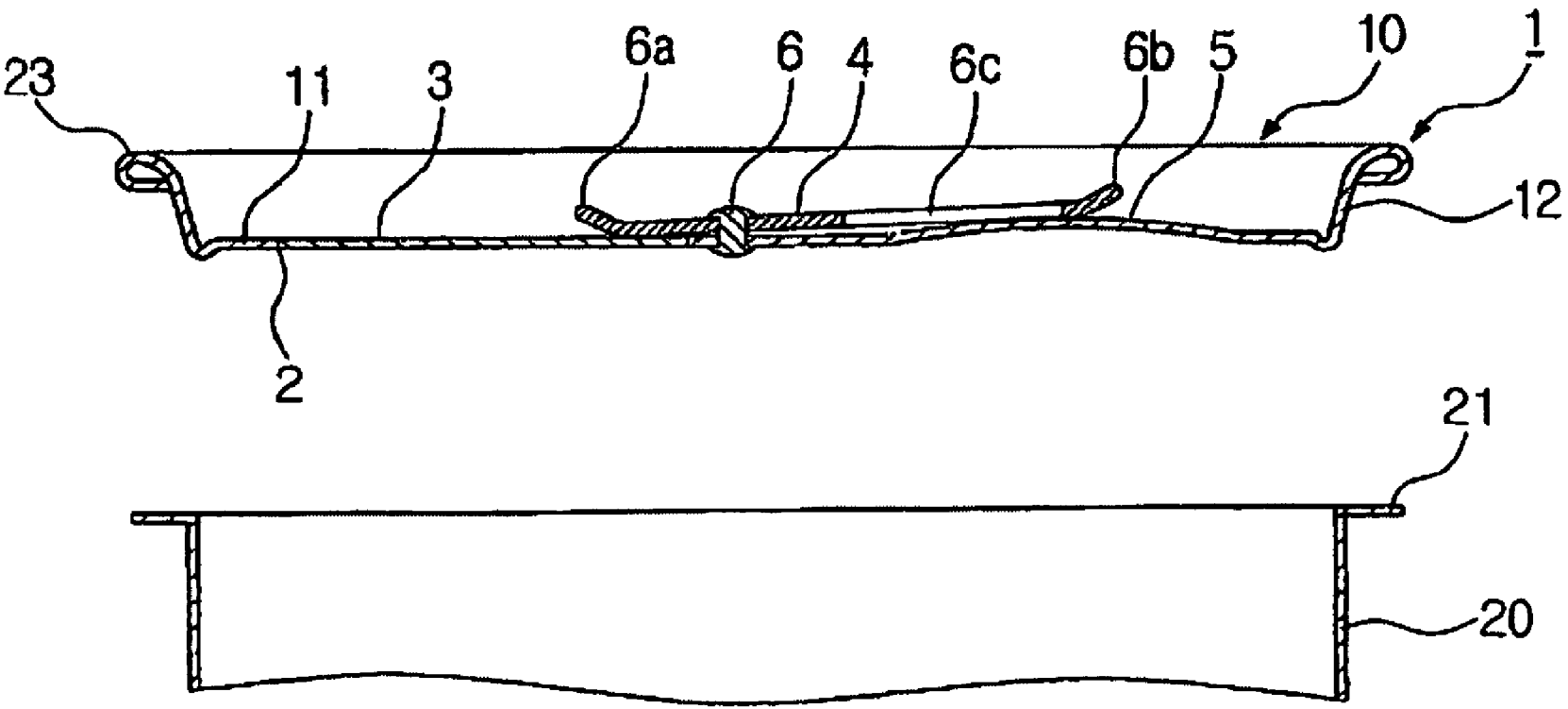
FIG. 1B is an exploded cross-sectional view of a can lid and can body combination.

The preferred embodiments of the present invention will be described in detail with reference to the attached drawings. FIG. 1 depicts a partial opening can type provided with an easy opening means related to the preferred embodiment of the present invention.

This partial opening type can is equipped with a cylindrical shaped main body(20) provided with a can bottom, not shown, and a can lid(1) which is wound and fastened on the top end opening of the can main body. This can lid(1) is provided with a lid main body(10) and a tab(4) for severing the scored section(2) for the partial opening engraved on the lid main body(10).

The lid main body(10) is comprised of a circular-shaped panel(11), a circumference wall(12) which elevates from the circumference edge of the panel(11), and a curl portion(23) which extends outward from the circumference wall(12) and gets wound together with the flange(21) of the can main body(20), where the partial opening score section(2) is formed on the circumference of the prearranged partial opening area(3) of the panel(11) and enables opening of the prearranged partial opening area(3) of the panel(11).

In addition, on the panel(11) of the can lid(1), a collapsing protrusion(5) which protrudes upward from the panel(11) is formed during the manufacturing process. After manufacturing, this collapsing protrusion(5) is elastically deformed and protrudes inward into the can main body(20) about the boundary between the collapsing protrusion(5) and panel(11) by the depressing action of the user and thus provides a concave section where a finger may be inserted.

The tab(4) is an oval shape and is fastened on the rivet(6) located on the panel(11). This tab(4) is arranged such that the longitudinal direction is along the direction of the diameter of the panel(11) and the tab end(6*a*) which severs the score section(2) is arranged near the score section(2), and the handle(6*b*) for lifting the tab(4) is arranged on the panel(11). The rivet(6) is located between the tab end(6*a*) and handle (6*b*) toward the tab end(6*a*). The handle(6*b*) is ring-shaped and a finger-hooking hole(6*c*) is formed thereon. The handle (6*b*) is arranged such that it lies over the collapsing protrusion (5). At a free state, the tab(4) is fastened to the rivet of the panel(11) which is lower than the collapsing protrusion(5) and therefore the handle(6*b*) is initially at an elevated state and the far end of the handle is on top of the collapsing protrusion(5) and is abutting the collapsing protrusion(5) without a gap.

Figure 2A:
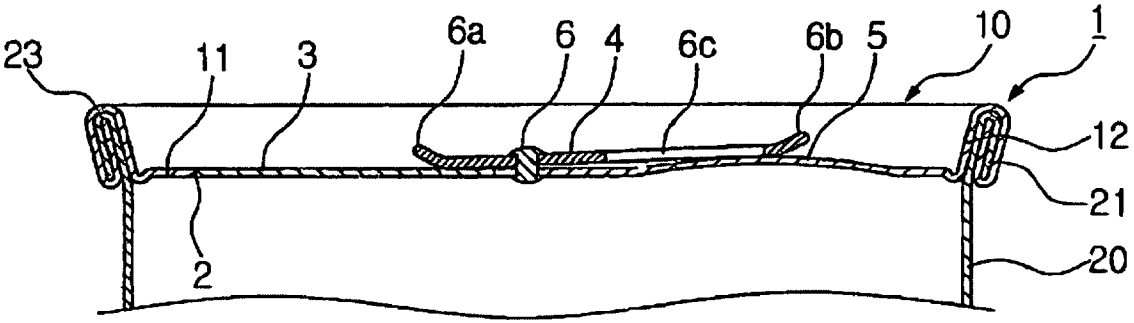
FIG. 2A is a cross-sectional view of the can lid of FIG. 1 depicting the collapsing protrusion in a before depression state.
Figure 2B:
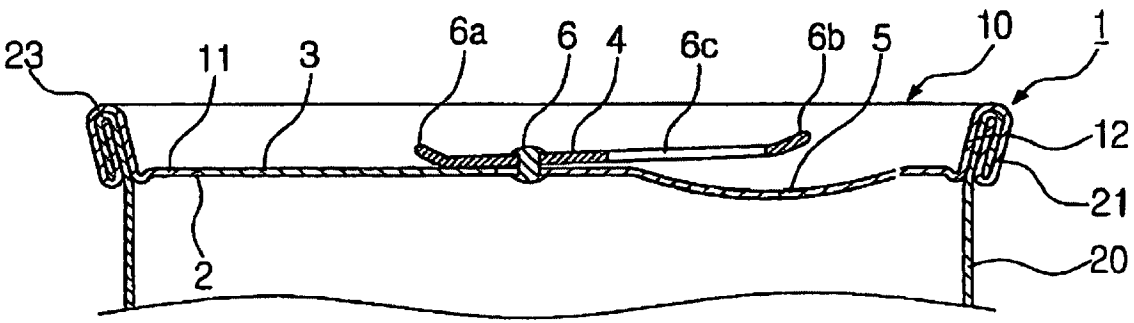
FIG. 2B is a cross-sectional view of the can lid of FIG. 1 depicting the collapsing protrusion in an after depression state.
Figure 3:
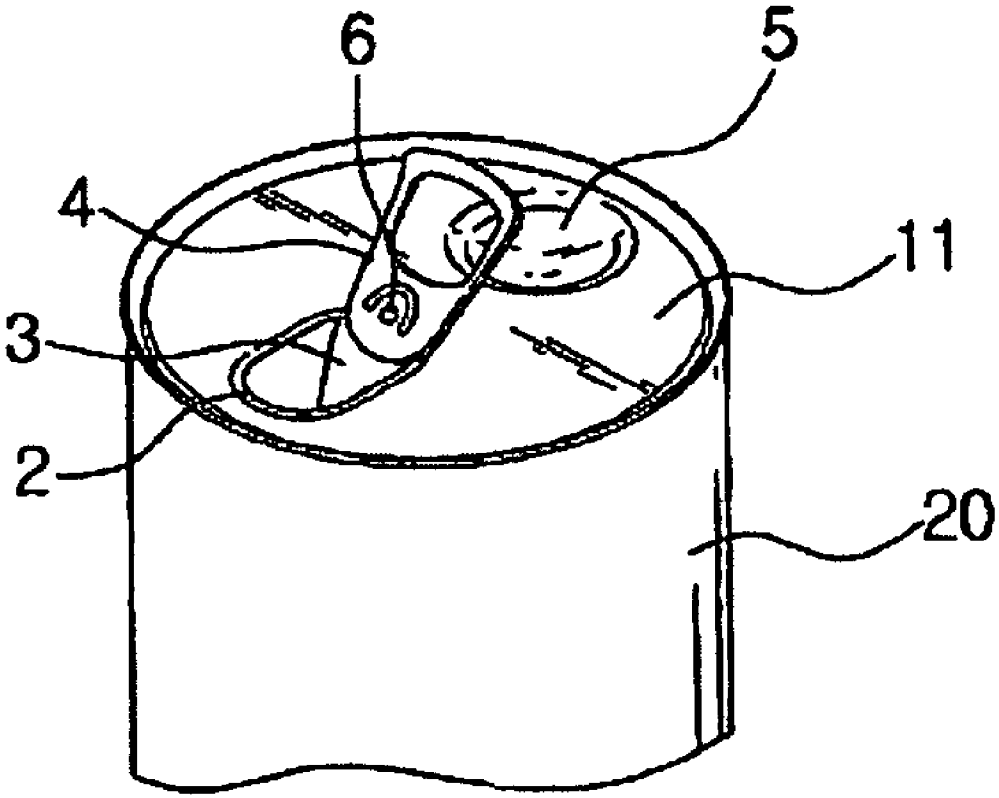
FIG. 3 is a perspective view showing the state after opening of the can lid of FIG. 1.

When the user depresses the collapsing protrusion(5), as depicted in FIG. 2, the collapsing protrusion elastically deforms and a gap is formed between the collapsing protrusion(5) and the far end of the handle(6*b*). In this case, the handle(6*b*) abuts the boundary of the collapsing protrusion(5) and thus a secure gap is formed. By providing a collapsing protrusion(5) as such, when the user depresses the collapsing protrusion(5) to form a partial opening on the can, a gap is formed and thereby hooking of the finger is facilitated and as a result, a partial opening on the can may be easily formed.

Therefore, because the collapsing protrusion(5) is not a concave shape during the manufacturing process of the can lid(1), it does not abut the handle(6*b*) of the tab or the gap is narrow and thus it is very difficult for other can lids to be inserted between the tab(4) and the panel(11) during the manufacturing process or transportation, and in turn there may be no cases of damage from contact with other cans.

It is obviously preferred that there is typography (not shown) printed on the collapsing protrusion intended as instructions or a logo and advertising.

In addition, as the material of the can lid(1), either one of aluminum or steel may be used. For the thickness of the panel, it is preferred that the thickness remains thin for easy elastic deformation.

In the above preferred embodiment, the shape of the collapsing protrusion is represented as a concentric circle. However, it is not limited to this shape and namely, it may be of any construction that is easily deformed and formed into a concave section by the depressing of the user. Also, although a can lid having a partial opening means has been described, it is obvious that the present invention may be applied to a can lid having a wholly opening means.

As described above in the present invention, by providing a collapsing protrusion, gripping of the tab handle is facilitated and thereby the opening of the can is made easy.

Also, the collapsing protrusion is not a concave shape during the manufacturing process and therefore the gap of the handle of the tab is narrow and thus it is difficult for other can lids to be inserted between the tab and panel during the manufacturing or transportation process and in turn there is no concern for the tab or concave portion being damaged from contact with other can lids.

The invention claimed is:

1. A can end configured to be attached to a can body, the can end comprising:

an end panel including a movable portion;

a score line in the end panel defining an openable panel portion;

a pull tab including a nose, a handle capable of being actuated such that the pull tab ruptures the score line, and a medial portion defined between the nose and the handle, the medial portion is coupled to the end panel such that the nose is proximal to the score line and the handle overlay the movable portion of the end panel;

the entire movable portion is disposed on a side of the medial portion opposite the nose, the movable portion is deformable between:

an up position in which the movable portion is convex, as viewed from above the can end, such that a first distance is defined as a minimal spacing between a top portion of the movable portion and a bottom portion of the handle, and the portion of the movable portion is capable of contacting the bottom portion of the handle, and a down position in which the movable portion is concave, as viewed from above the can end, such that the movable portion is spaced apart from the handle and the first distance has expanded to a second distance that is substantially greater than the first distance so as to form a gap between the bottom portion of the handle and the top portion of the movable portion to facilitate access by a user's finger to the handle for actuating the handle;

wherein (i) the movable portion is deformable from the up position to the down position before the handle has been actuated and the score line is ruptured, and (ii) the movable portion, after being deformed to the down position, remains in the down position after the handle has been actuated and the score line is ruptured.

2. The can end of claim 1 wherein the handle is elevated relative to the nose at least while the movable portion is in the up position.

3. The can end of claim 1 wherein a periphery of the end panel defines a reference plane, the movable portion in its up position extends upwardly relative to the reference plane and the movable portion in its down position extends downwardly relative to the reference plane.

4. The can end of claim 1 wherein the deformation of the movable portion is elastic.

5. The can end of claim 1 wherein the movable portion when in the up position diminishes the likelihood of insertion of other ends between the moveable portion and the tab handle.

6. The can end of claim 1 wherein the movable portion is deformed from its up position to its down position after manufacturing of the end.

7. The can end of claim 6 wherein the movable portion is deformed from its up position to its down position by the user.

* * * * *